US005114494A

United States Patent [19]

Remec

[11] Patent Number: 5,114,494

[45] Date of Patent: May 19, 1992

[54] MASK WASHING SYSTEM AND METHOD

[75] Inventor: Thomas M. Remec, Des Plaines, Ill.

[73] Assignee: Zenith Electronics Corporation, Glenview, Ill.

[21] Appl. No.: 517,997

[22] Filed: May 2, 1990

[51] Int. Cl.[5] ..... B08B 9/00

[52] U.S. Cl. ..... 134/1; 134/184

[58] Field of Search ..... 134/1, 184

[56] References Cited

U.S. PATENT DOCUMENTS

| | | | |
|---|---|---|---|
| 2,845,077 | 7/1958 | Brenson | 134/1 |
| 2,896,640 | 7/1959 | Randall et al. | 134/1 |
| 2,950,725 | 8/1960 | Jacke et al. | 134/1 |
| 3,033,710 | 5/1962 | Hightover et al. | 134/1 |
| 3,158,886 | 12/1964 | Grimes | 134/1 |
| 4,790,786 | 12/1988 | Strauss | 445/68 |
| 4,974,616 | 12/1990 | Lee | 134/1 |

*Primary Examiner*—Asok Pal

[57] ABSTRACT

A system and method for ultrasonic cleaning of an in-process shadow mask contaminated with polymeric films such as are employed in color cathode ray tube (CRTs) screen production. The ultrasonic bath contains a solution having a chemically active agent for degrading and removing a targeted cross-linked polymer film contaminant from the shadow mask. The cleaning solution may also have more conventional materials in addition to the chemically active agent. The chemically active agent, attacks PVA films contaminating the mask, may be hydrogen peroxide or a periodate. The agents act to chemically degrade the polymeric contaminants. Contaminants are thus removed from the shadow mask during CRT production to reduce clogging of shadow mask apertures and facilitate attachment of the shadow mask to a faceplate-mounted support structure. The very low concentrations of chemically active agents required in conjunction with ultrasonic energy allows for direct solution-to-transducer contact while providing good mask decontamination.

37 Claims, 1 Drawing Sheet

MASK WASHING SYSTEM AND METHOD

CROSS-REFERENCE TO RELATED PATENT

This application is related to, but in no way dependent upon U.S. Pat. No. 4,790,786, issued Dec. 13, 1988, and assigned to the assignee of the present application.

BACKGROUND OF THE INVENTION

This invention relates generally to the manufacture and assembly of color cathode ray tubes (CRTs) and is particularly directed to the processing of shadow masks used in color CRTs.

The shadow mask is a part of the CRT front assembly and is located closely adjacent to the CRT's faceplate. The CRT front assembly primarily comprises the faceplate with its screen consisting of a black matrix and deposits of light-emitting phosphors, the shadow mask and support means for the shadow mask. In the past, domed shadow masks have been cleaned prior to installation in a color CRT using an ultrasonic bath containing de-ionized water and in some cases a dispersing agent or a surfactant. The present invention may be used in cleaning the standard, domed shadow mask or the recently developed flat tension masks (FTMs) used in color CRTs having a flat glass faceplate. As used herein, the term "FTM shadow mask", or "mask" means an apertured metallic foil which may, by way of example, be approximately 0.001 inch thick, or less. The following description is directed toward use of the present invention with FTM shadow masks, it being understood that this discussion is equally applicable to standard domed shadow masks.

The FTM shadow mask must be securely supported and maintained in high tension a predetermined distance from the inner surface of the CRT faceplate; this distance is known as the "Q-distance". Attachment of the FTM shadow mask may be by various means, typically by welding. As is well known in the art, the FTM shadow mask acts as a color-selection electrode, or parallax barrier, which ensures that each of the three electron beams lands only on its assigned phosphor deposits. The FTM shadow mask may either be "new", i.e., its first use the manufacturing process, or "used", i.e., recovered from a rejected front assembly for re-installation in another front assembly. FTM shadow mask recovery for re-installation is justified by the high cost of these color CRT components. It is these recovered FTM shadow masks which present particular problems in terms of contaminant removal and disposal.

During CRT assembly, the FTM shadow mask is securely attached with its support frame to the inner surface of the CRT's flat glass faceplate. Referring to FIG. 1, there is shown a plan view of a first side of a prior art factory fixture frame 13 for use in maintaining an FTM shadow mask in a tightly stretched condition prior to installation in a color CRT. The factory fixture frame 13 is disclosed and claimed in the above cross-referenced patent, the disclosure of which is incorporated herein by reference. The factory fixture frame 13 provides for high precision in the registration of a flat in-process shadow mask with a faceplate during manufacture. The reusable factory fixture frame 13 includes a first side and comprises a generally rectangular frame means and quick-release mechanical mask-retaining means for temporarily and removably supporting an in-process shadow mask 14 in tension. Frame 13 is indicated as supporting shadow mask 14 in tension by means of mechanical mask-retaining means 88. Factory fixture frame 13 provides for the cementless and weldless quick-retention of in-process shadow mask 14 out of the plane of the mask. The factory fixture frame 13 includes handles 90A, 90B and 90C for convenience in handling during manufacture as the factory fixture frame is inserted in and removed from a mask tensing-clamping machine (not shown in the figure for simplicity). When the in-process mask 14 is fully expanded by the heat of upper and lower platens (also not shown), the mask is clamped, and the platens are withdrawn. The mask tenses as it cools, and is held in tension by the clamping means 88 which are a component of the factory fixture frame 13. Groove means **132*a*, 132*b* and 132*c* provide for proper alignment and registration of the FTM shadow mask 14 as the factory fixture frame 13 and shadow mask are lowered into registration with a lighthouse (not shown) for exposing the screening surface of an in-process faceplate to radiation from a light source within the lighthouse. Other functions performed by the factory fixture frame 13** and additional structural details thereof are described in the aforementioned cross-referenced patent. During processing and attachment of the FTM shadow mask, various contaminants are produced which may inhibit CRT assembly and may even degrade CRT performance following manufacture.

For example, during the processing of the panel, the FTM shadow mask may inadvertently come in contact with various chemical materials. Most often, these materials may become lodged in the precisely-etched apertures of the shadow mask. When this happens, the photographic process involved in the manufacture of the dark surround (also called "grille" or "black matrix") is inhibited to such a localized extent that the screen on the faceplate must be rejected. In addition, the various chemical cleaning agents may form a residue on the periphery of the FTM shadow mask. As little as 0.001" of slurry residue on the mask can change the Q-distance upon installation on the mask-supporting rails enough to introduce electron beam landing errors. Deposits of slurry residue on the periphery of the FTM shadow mask may also prevent good bonding, such as via a weldment, between the mask and its support structure.

Another case of this contamination is where the aforementioned chemical material is on the border of the shadow mask array. In the case of conventional CRT product, failure to remove this material can provide a source of particles which can move to the CRT gun and inhibit its operation, or can move onto the array of the shadow mask and interfere with the electron beam by causing a plug or a charged particle. These are both cause for rejection of the product. In the case of FTM shadow masks, this material can present a barrier between the shadow mask and its support structure and prevent satisfactory welding of these parts—a necessary operation in the fabrication of this product.

There are a variety of sources of contamination, including packaging materials from the shadow mask manufacturer as well as various solutions and slurries used in the process of manufacturing CRTs. In addition, workers in the manufacturing process generate contamination from saliva, skin and hair which require removal from the shadow mask before processing.

Prior attempts to clean shadow masks in automated equipment have generally involved using ultrasonic transducers in conjunction with water to which non-reactive chemicals have been added.

The present invention addresses the aforementioned limitations of the prior art and provides an improved shadow mask washing system for cleaning in-process shadow masks by directing ultrasonic pressure waves on the shadow mask, followed by rinsing, and then drying the shadow mask. The ultrasonic bath stage makes use of an improved cleaning solution having a chemically active component and allows for removal of the contaminants which inhibit shadow mask installation and degrade its performance. This invention also prolongs the life of washing system filters, requiring less frequent replacement of the filter elements.

OBJECTS OF THE INVENTION

Accordingly, it is an object of the present invention to clean shadow masks prior to installation in color CRTs.

It is another object of the present invention to remove polymeric film formers, particularly polyvinyl alcohol films, and any filler particles or solid contaminants such as phosphor particles from a shadow mask prior to installation in a color CRT.

Yet another object of the present invention is to remove various contaminants from the liquid wash system of a shadow mask during processing using a solution containing a surface active agent, an antifoam agent, detergent builders and various sequestering agents for stronger cleaning action and prolonging system filter life.

A further object of the present invention is to direct focused pressure waves on in-process shadow masks displaced along a CRT assembly line in washing the shadow masks with a solution and in a manner which prevents clogging of shadow mask apertures with various common contaminants.

A still further object of the present invention is to add selective agents to a cleaning solution for cleaning an in-process shadow mask and removing various contaminants therefrom prior to assembly in a color CRT.

Still another object of the present invention is to provide a shadow mask washing system and method therefore which is particularly adapted for cleaning either new or recycled FTM shadow masks in removing various contaminants therefrom.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings.

DESCRIPTION OF THE PREFERRED EMBODIMENT

Figure 1:
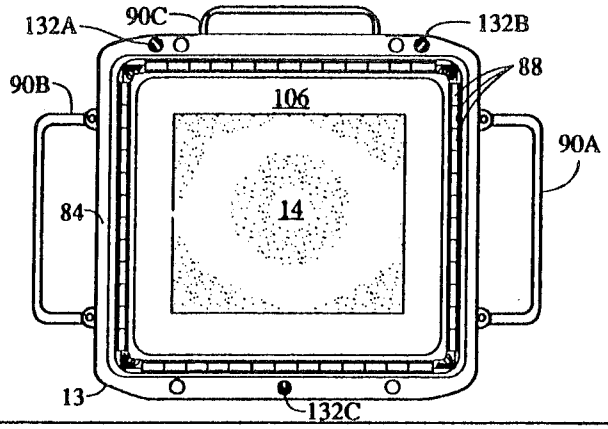
FIG. 1 is a plan view of a first side of a prior art factory fixture frame for use in maintaining an FTM shadow mask in a tightly stretched condition during mask washing by the present invention.
Figure 2:
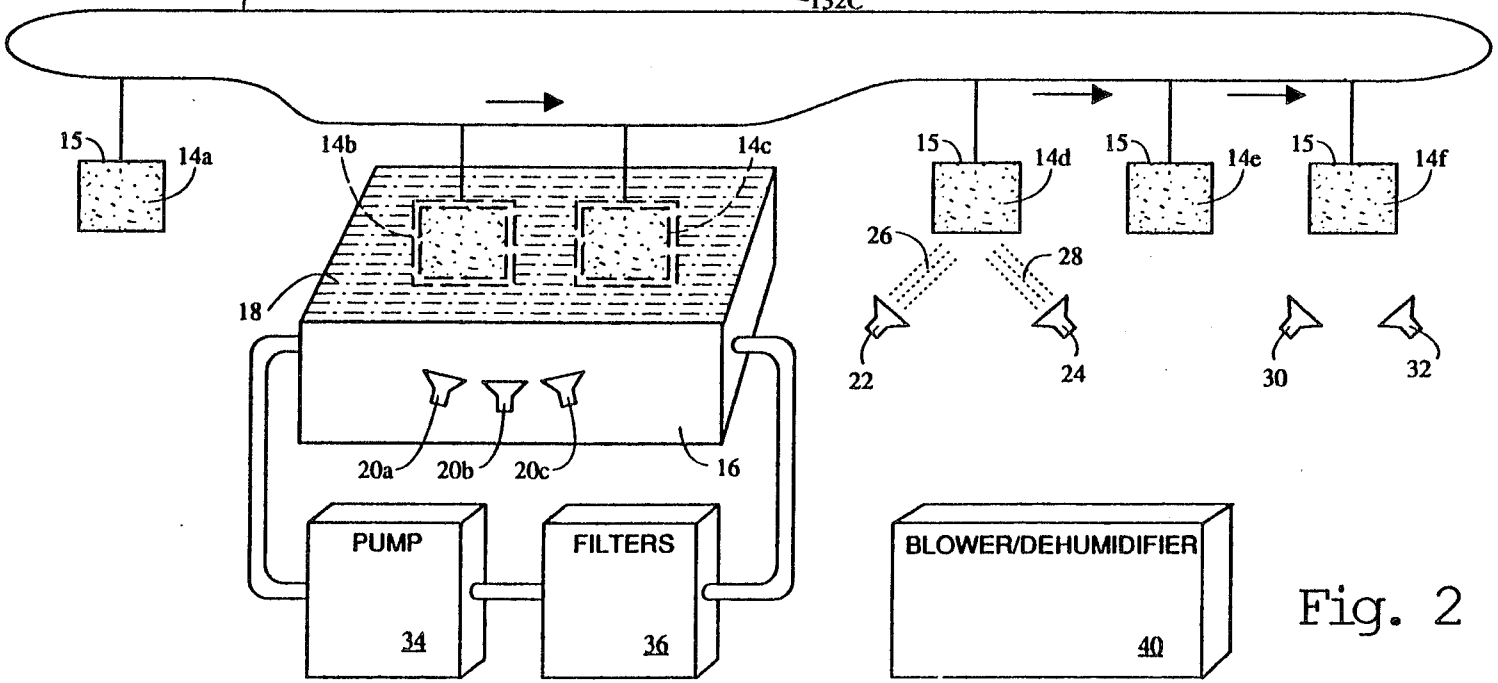
FIG. 2 is a simplified schematic diagram of an improved shadow mask washing system and method therefore in accordance with the present invention.

Referring to FIG. 2, there is shown in simplified schematic diagram form an improved shadow mask washing system 10 in accordance with the principles of the present invention. While the following discussion is directed toward the use of the present invention in cleaning FTM shadow masks, it should be understood that this invention is equally applicable for cleaning standard, domed shadow masks. The improved shadow mask washing system 10 includes an endless conveyor system 12 from which are suspended a plurality of FTM shadow masks **14*a*–14*f* which are processed sequentially at various stages in the shadow mask washing system 10. Each of the FTM shadow masks 14*a*–14*f* has been mounted in an earlier operation to a mask fixture 15 to maintain the shadow mask in a tightly stretched condition. The mask fixture 15 may be conventional in design such as the factory fixture frame shown in FIG. 1 and described above. Each combination of FTM shadow mask and mask fixture is attached at a later stage to the front assembly of a color CRT which includes a flat glass faceplate (not shown) during CRT assembly. The shadow mask washing system 10** of the present invention is adapted for cleaning shadow mask and mask fixture combinations prior to integration in a color CRT. The FTM shadow mask may be either newly fabricated or recycled, both types of which are subject to picking up contaminants prior to integration into a color CRT during manufacture.

The first stage in the shadow mask washing system 10 in processing the FTM shadow masks as they are moved in the direction of the arrows in the figure includes a bath 16. The bath 16 includes a dip tank open at the top which contains a cleaning solution 18. The cleaning solution 18 is circulated through the bath 16 by means of a pump 34 in a closed circulating system which also may include one or more filters 36 for removing contaminants from the cleaning solution. Collection of various contaminants in the filters 36 requires periodic cleaning and/or replacement of the individual filter elements. The present invention not only removes contaminants from the washing system, but also degrades these contaminants which prolongs filter life and reduces the frequency of filter element replacement.

As shown in the figure, each of the FTM shadow masks **14*a*–14*f* is moved in the direction of the arrows and is dipped into and removed from the cleaning solution 18 within the bath 16 as it is linearly displaced along the conveyor system 12. The bath 16 includes a plurality of ultrasonic pressure transducers 20*a*, 20*b* and 20*c* for directing ultrasonic waves on each of the FTM shadow masks as they are dipped into and submerged in the cleaning solution 18. As shown in the figure, the three pressure transducers 20*a*, 20*b* and 20*c* may be positioned within a lateral wall of the bath 16 and are oriented with respect to and spaced from the FTM shadow masks so as to direct focused pressure waves thereon. As contaminants are removed from the FTM shadow masks by the focus pressure waves, the contaminants are further removed from the closed, circulating cleaning solution by means of the aforementioned filters 36**.

The next step in FTM shadow mask processing involves rinsing each of the shadow masks following its removal from the bath 16. Rinsing of the FTM shadow mask, as shown for the case of shadow mask **14*d* in the figure, is accomplished by means of a plurality of spray nozzles 22 and 24 oriented and positioned to direct respective water jets 26, 28 of compressed water onto the FTM shadow masks as they are displaced along the conveyor system 12. In a preferred embodiment, the water jets 26 and 28** are comprised of either distilled or de-ionized water, which is very hard water from which various ions have been removed. Although not shown in the figure, rinse nozzles would also be directed onto the aft surface of each of the FTM shadow masks. In a preferred embodiment, the FTM shadow masks are subjected to four rinse stations with de-ionized water, wherein each station has many nozzles directed at the front and back surfaces of the FTM shadow mask.

The last stage includes a plurality of blower nozzles 30 and 32 for directing compressed air at a temperature elevated slightly above ambient room temperature onto each of the FTM shadow masks. Each of the blower nozzles 30, 32 is aimed at the FTM shadow masks to ensure that a completely dry assembly emerges from the shadow mask washing system 10. In addition, some blower nozzles may also be positioned, with their operation timed, to blow on the FTM shadow mask and mask fixture combination between the rinsing and drying stations as well as between the individual drying stations. Finally, the air within the shadow mask washing system 10 is circulated by means of an appropriate blower and dehumidifying arrangement 40 to prevent a build-up in humidity in the environment within the flat tension mask washing system caused by evaporation of water removed from the FTM shadow masks.

Table I briefly summarizes the FTM washing cycle carried out by the shadow mask washing system 10 in accordance with a preferred embodiment of the present invention. From Table I, it can be seen that a preferred embodiment of the shadow mask washing system 10 uses twenty-four pressure (ultrasonic) transducers, nominally rated at 750 watts each, directed at each pair of the FTM shadow masks displaced through the bath 16. Each FTM shadow mask is exposed to approximately 60 seconds of incident pressure waves (30 seconds per station) produced by eight transducers. The transducer surfaces are positioned approximately five inches from the FTM shadow mask as it is submerged in and displaced through the bath 16. The drying stage preferably includes six stations which direct heated, compressed air onto each of the FTM shadow masks. In a preferred embodiment, the conveyor system 12 displaces two FTM shadow masks which are suspended therefrom in a back-to-back arrangement through the shadow mask washing system 10. The shadow mask washing system makes use of an indexing timer which advances each pair of shadow masks one station every 30 seconds. The temperatures of all fluids (bath water, rinse water and compressed air) are controlled. Similarly, pressures are also controlled to provide optimum flow rates of these fluids.

In accordance with the present invention, specific chemical cleaning agents can be added to the cleaning solution 18 which is primarily water within the bath 16. In a preferred embodiment, a chemically active component is added to the water in the bath 16 to degrade polymeric film formers (particularly polyvinyl alcohol films, filled or unfilled) which become deposited as contaminants on the FTM shadow mask. In a preferred embodiment, the chemically active agent is hydrogen peroxide ($H_2O_2$), sulfuric acid, sodium hypochlorite, sulfamic acid ($NH_2SO_3H$), or a periodate, such as potassium periodate ($KIO_4$), sodium periodate $NaIO_4$, or periodic acid ($HIO_4$).

TABLE I

FTM PRE-GRILLE MASK WASHER DESCRIPTION

| STATION | FUNCTION | REMARKS |
|---|---|---|
| Ultrasonic Wash | Load | |
| Ultrasonic Wash | Load | |
| Ultrasonic Wash | Empty | Motion down into bath |
| Ultrasonic Wash | Ultrasonic bath | Recirculated bath water |
| Ultrasonic Wash | Ultrasonic bath | Recirculated bath water |
| Ultrasonic Wash | Ultrasonic bath | Recirculated bath water |
| Rinse | Empty | Motion up out of bath |
| " | Empty | |
| " | Rinse | D. I. water |
| " | Rinse | D. I. water |
| " | Rinse | D. I. water |
| " | Rinse | D. I. water |
| Drying | Empty | |
| " | Dry | Compressed air |
| " | Empty | |
| " | Dry | Compressed air |
| " | Dry | Motion up to unload level |
| " | Dry | Compressed air |
| " | Dry | Compressed air |
| " | Unload | |
| " | Unload | |

Small amounts of hydrogen peroxide are used, e.g., less than 0.5% hydrogen peroxide is preferred, although as much as 2% hydrogen peroxide has proven useful in the cleaning solution. The use of these chemically active agents degrades and breaks down the hardened PVA compounds as well as a dichromate sensitizer (either ammonium, potassium or sodium) which have dried on the FTM shadow mask. These compounds are very resistant to non-reactive chemical cleaning, but are easily removed using hydrogen peroxide or a periodate. These chemically active agents not only degrade and remove these hardened PVA compounds, but also allow for removal of phosphor particles lodged in the apertures of the FTM shadow mask and maintained therein by means of the aforementioned PVA compound. The PVA compounds form a crosslinked film which retains phosphor and other types of particle contaminants on the FTM shadow mask. The present invention thus removes both hardened PVA compounds and particle contaminants, as well as other forms of contaminants, from the apertures in the FTM shadow mask, as well as from peripheral portions of the shadow mask which facilitates subsequent attachment of the shadow mask to a support structure on the CRT's glass faceplate such as by welding. In a preferred embodiment, the pH of the cleaning solution is adjusted (upward for $H_2O_2$) for optimizing the performance of the chemically active agent against contaminants without attacking the shadow mask. Various other chemical agents may be added to the cleaning solution 18 for specific results. For example, a surface active agent, such as a detergent, may be added to the cleaning solution 18 to promote the activity of the ultrasonic pressure waves. Also, an antifoam agent may be incorporated to minimize bubbles and foam which is circulated in the system and which may contaminate the rinse water. In addition, silicates, carbonates, and sequestering agents may be added at low concentrations to provide stronger cleaning action for specific forms of dirt, soil or contamination.

Binders other than the disclosed PVA compounds may be used in fixing the phosphor array on the inner surface of the CRT's glass faceplate. For example, another approach employs a polyvinyl pyrrolidone binder with a polyacrylamide and a diazo (specifically 4,4'-diazido stilbene-2,2'-disulfonic acid disodium salt) sensitizer. Sodium hypochlorite is the preferred chemically active agent for degrading this binder/sensitizer combination. Yet another approach employs polyvinyl alcohol with polyvinyl pyrrolidone and a diazo sensitizer. For this system, the preferred degrading agent is sulfamic acid.

There has thus been shown an improved flat tension mask washing system which includes a mask washing stage, a rinsing stage and a drying stage. In the wash stage, FTM shadow masks are displaced by means of a conveyor system and are dipped into a cleaning solution bath. The cleaning solution includes various chemically active agents for removal of contaminants from the FTM shadow mask prior to installation in a color CRT.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A method for cleaning a cathode ray tube (CRT) shadow mask contaminated by a cross-linked polymer film adhering tenaciously thereto as a result of CRT phosphor screen manufacturing processes, the cleaning taking place prior to mask installation in the CRT, and wherein the shadow mask includes a large number of small, closely spaced apertures therein, the method comprising the steps of:

washing the shadow mask in an ultrasonic bath, by placing the shadow mask in a cleaning solution containing a chemically active agent capable of degrading the bonds of the polymer film by chemical action;

directing pressure waves of said solution onto the shadow mask thereby removing the polymer film from the shadow mask;

rinsing the shadow mask with water; and directing an air flow on the shadow mask for drying the shadow mask.

2. The method of claim 1 wherein said chemically active agent is hydrogen peroxide ($H_2O_2$).

3. The method of claim 1 further comprising the step of adjusting a pH value of the cleaning solution for improving removal of the contaminants from the shadow mask while preventing degradation of said shadow mask by said hydrogen peroxide.

4. The method of claim 3 wherein the step of adjusting the pH value of the cleaning solution containing the hydrogen peroxide includes increasing the pH value.

5. The method of claim 2 wherein said hydrogen peroxide comprises less than 2.0% of the cleaning solution.

6. The method of claim 5 wherein said hydrogen peroxide comprises less than 0.5% of the cleaning solution.

7. The method of claim 1 wherein said chemically active agent is a periodate.

8. The method of claim 7 wherein said periodate is potassium periodate ($KIO_4$).

9. The method of claim 7 wherein said periodate is sodium periodate ($NaIO_4$).

10. The method of claim 7 wherein said periodate is periodic acid ($HIO_4$).

11. The method of claim 1 wherein said chemically active agent is sulfuric acid.

12. The method of claim 1 wherein said chemically active agent is sulfamic acid.

13. The method of claim 1 wherein said chemically active agent is sodium hypochlorite.

14. The method of claim 1 further comprising the step of adding an antifoam agent to said cleaning solution.

15. The method of claim 1 further comprising the step of adding a silicate to said cleaning solution.

16. The method of claim 1 further comprising the step of adding a carbonate to said cleaning solution.

17. The method of claim 1 further comprising the step of adding a sequestering agent to said cleaning solution.

18. The method of claim 1 wherein the shadow mask is an FTM shadow mask, said method further comprising the step of maintaining the FTM shadow mask in a tightly stretched condition.

19. Apparatus for cleaning a cathode ray tube (CRT) shadow mask contaminated by a cross-linked polymer film adhering tenaciously thereto as a result of CRT phosphor screen manufacturing processes, the cleaning taking place prior to mask installation in the CRT, and wherein the shadow mask includes a large number of small, closely spaced apertures therein, said apparatus comprising:

ultrasonic cleaning means for washing the shadow mask with a cleaning solution having a chemically active agent for degrading the polymeric film mask contaminants by chemically attacking the bonds of the polymer film and including means for directing pressure waves of said solution onto the shadow mask for degrading the film and removing it from the shadow mask;

means for rinsing the shadow mask with water; and means for directing an air flow on the shadow mask for drying the shadow mask.

20. The apparatus of claim 19 wherein said chemically active agent is hydrogen peroxide ($H_2O_2$).

21. The apparatus of claim 20 wherein a pH value of the cleaning solution is adjusted for improving removal of the contaminants from the shadow mask while preventing degradation of said shadow mask by said hydrogen peroxide.

22. The apparatus of claim 21 wherein the pH value of the cleaning solution containing the hydrogen peroxide is adjusted by increasing the pH value.

23. The apparatus of claim 20 wherein said hydrogen peroxide comprises less than 2.0% of the cleaning solution.

24. The apparatus of claim 23 wherein said hydrogen peroxide comprises less than 0.5% of the cleaning solution.

25. The apparatus of claim 19 wherein said chemically active agent is a periodate.

26. The apparatus of claim 25 wherein said periodate is potassium periodate ($KIO_4$).

27. The apparatus of claim 25 wherein said periodate is sodium periodate ($NaIO_4$).

28. The apparatus of claim 25 wherein said periodate is periodic acid ($HIO_4$).

29. The apparatus of claim 19 wherein said chemically active agent is sulfuric acid.

30. The apparatus of claim 19 wherein said chemically active agent is sulfamic acid.

31. The apparatus of claim 19 wherein said chemically active agent is sodium hypochlorite.

32. The apparatus of claim 19 further comprising an antifoam agent in said cleaning solution.

33. The apparatus of claim 19 further comprising a silicate in said cleaning solution.

34. The apparatus of claim 19 further comprising a carbonate in said cleaning solution.

35. The apparatus of claim 19 further comprising a sequestering agent in said cleaning solution.

36. The apparatus of claim 19 wherein the shadow mask is an FTM shadow mask, said apparatus further comprising means for maintaining the FTM shadow mask in a tightly stretched condition.

37. The apparatus of claim 19 wherein the ultrasonic cleaning means comprises a bath having ultrasonic transducers in direct contact with the cleaning solution.

* * * * *